US007033150B2

(12) United States Patent
Nozaki et al.

(10) Patent No.: US 7,033,150 B2
(45) Date of Patent: Apr. 25, 2006

(54) HERMETIC TYPE COMPRESSOR

(75) Inventors: Tsutomu Nozaki, Kashiwa (JP); Nobuo Abe, Ohira (JP); Kensuke Kato, Ohira (JP); Takeo Watanabe, Ohira (JP)

(73) Assignee: Hitachi Home & Life Solutions, Inc., Tokyo (JP)

( * ) Notice: Subject to any disclaimer, the term of this patent is extended or adjusted under 35 U.S.C. 154(b) by 319 days.

(21) Appl. No.: 10/425,931

(22) Filed: Apr. 30, 2003

(65) Prior Publication Data

US 2004/0057850 A1 Mar. 25, 2004

(30) Foreign Application Priority Data

Sep. 20, 2002 (JP) ..... 2002-274257

(51) Int. Cl.
*F04B 39/10* (2006.01)

(52) U.S. Cl. ..... 417/569; 417/571; 417/415; 417/902

(58) Field of Classification Search ..... 417/569, 417/571, 415, 902
See application file for complete search history.

(56) References Cited

U.S. PATENT DOCUMENTS 5,848,882 A * 12/1998 Hashimoto et al. ..... 417/569
6,099,276 A * 8/2000 Taguchi ..... 417/569
6,120,259 A * 9/2000 Miyaji et al. ..... 417/269
6,171,076 B1 * 1/2001 Gannaway ..... 417/350
6,174,147 B1 * 1/2001 Tarutani et al. ..... 417/569

* cited by examiner

*Primary Examiner*—Charles G. Freay
*Assistant Examiner*—Ryan Gillan
(74) *Attorney, Agent, or Firm*—Antonelli, Terry, Stout and Kraus, LLP.

(57) ABSTRACT

A high-performance hermetic type compressor in which the influence of a cylinder bore deformation caused during assembly is reduced and the sealing tightness between a piston and a cylinder block is improved. A bore hole in the cylinder block has a hollow portion. Depth H1 of the hollow portion is larger than thickness H2 of compression space V at the moment when the pressure in the compression space V reaches the discharge pressure level Pd.

7 Claims, 4 Drawing Sheets

HERMETIC TYPE COMPRESSOR

FIELD OF THE INVENTION

The present invention relates to a hermetic type compressor which is used in a refrigerator, air conditioner or the like, and more particularly to a hermetic type compressor with a cylinder block.

BACKGROUND OF THE INVENTION

In a conventional hermetic type compressor which is used in a refrigerator, air conditioner or the like, refrigerant is compressed and the compressed refrigerant is sent to a refrigeration cycle. There are two types of refrigerants used for this purpose: CFC refrigerants and natural refrigerants. To reduce global warming impacts, the use of a natural refrigerant is desirable.

When a hydrocarbon refrigerant as a natural refrigerant is used, the cylinder capacity must be larger in order to obtain the same level of refrigerating capacity as when a CFC refrigerant is used, and in case of a closed type reciprocating compressor, the cylinder bore diameter must be larger.

As the cylinder bore diameter increases, the seal length between the piston and cylinder bore increases. This is one of the major reasons for deterioration in the hermetic type compressor performance due to compressed refrigerant leaks between the piston and cylinder bore.

One of the reasons for refrigerant leaks which occur between the piston and cylinder bore is a deformation of the cylinder bore. A cylinder bore deformation occurs when a suction valve plate, a cylinder head, a discharge valve plate, a head cover and the like are fastened and secured to the open end face of the cylinder block.

In a conventional method of reducing the cylinder bore deformation which occurs in fastening and securing the cylinder head to the cylinder block with bolts, the cylinder head is fastened to the cylinder block with bolts through a valve plate warped on both sides towards the cylinder head (see patent literature 1). Another conventional method is to provide a groove near a bolt hole in the cylinder block to prevent the bolt fastening stress on the bore (see patent literature 2).

Here, patent literature 1 refers to Japanese Patent Laid-open No. S63(1988)-230975 (FIGS. 3 to 11) and patent literature 2 refers to Japanese Patent Laid-open No. 2000-205136 (FIGS. 3, 7 and 8).

However, the conventional fastening methods have the following problems.

In the method which uses a valve plate as described in patent literature 1, the valve plate is warped and thus leakage of compressed gas easily occurs on the surface of contact between the discharge valve plate and cylinder head, leading to instability in compressor performance.

In the method as suggested in patent literature 2, where a groove is provided near a bolt hole in the cylinder block, the groove must be deep enough, resulting in deterioration in workability.

SUMMARY OF THE INVENTION

The present invention has been made to solve the above problems and its primary object is to minimize leakage of compressed gas by reducing the deformation of a bore which occurs when a bolt is tightened.

According to a first aspect of the present invention, the above object is achieved by a hermetic type compressor having an airtight container which incorporates: a cylinder having a bore in which a piston reciprocates; a valve assembly which closes the open end of the bore; and a bolt which fastens the valve assembly, wherein, at the moment when the pressure in a compression space comprised of the cylinder bore, piston and valve assembly, reaches the level of discharge pressure, the distance from the open end of the bore to the position of the tip of the piston is shorter than the distance from a plane flush with the open end of the bore to the beginning of an internally threaded portion which is to engage with the bolt passed through a hollow portion in the cylinder.

According to a second aspect of the invention, the internally threaded portion may be located in the cylinder or the bolt fastens the valve assembly through an internally threaded nut.

Here, the valve assembly is comprised of a cylinder head attached to the cylinder bore open end, discharge valve plate, head cover and the like.

In the above structure, it is possible to reduce leakage of compressed refrigerant from the compression space when the pressure in the compression space is near the discharge pressure level and the sealing tightness between the piston and the cylinder bore is required.

Thus, according to the present invention, the cylinder head and other components can be fastened and secured to the cylinder block with bolts without deteriorating the sealing tightness between the cylinder block and the piston so that a highly efficient compressor can be realized.

DETAILED DESCRIPTION OF THE PREFERRED EMBODIMENTS

Next, preferred embodiments of the present invention will be described referring to the accompanying drawings.

Figure 1:
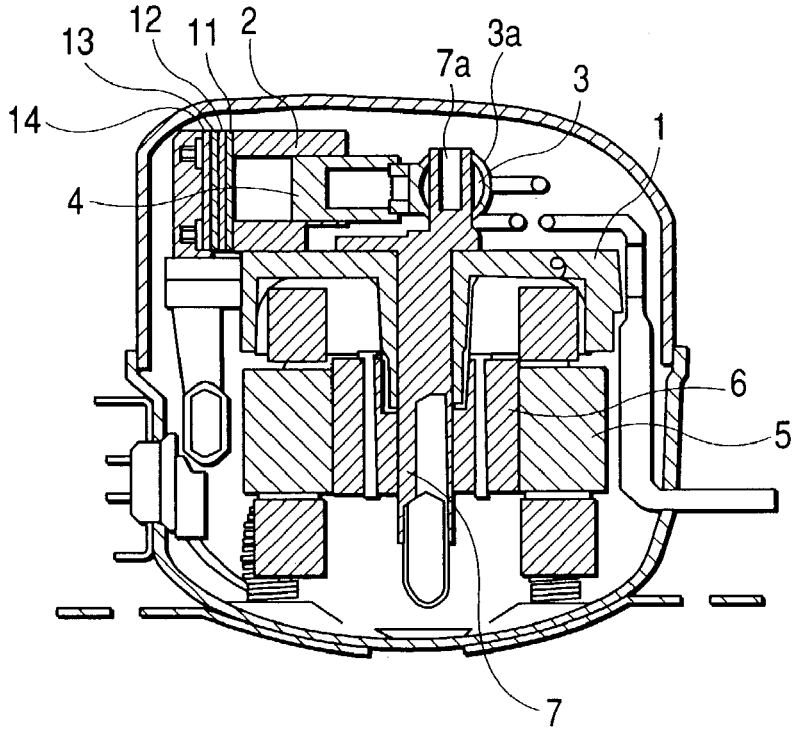
FIG. 1 is a longitudinal sectional view showing a displacement compressor according to an embodiment of the present invention.

FIG. 1 shows a reciprocating compressor according to the present invention where, inside a cylinder block 2 located over a frame 1 in an airtight container, a piston 4 with a slide tube 3*a* attached to its end reciprocates, constituting a compression element. Located under the frame 1 are a stator 5 and a rotor 6 which make up a motor. A crank pin 7*a* is located off the center of rotation of a crank shaft 7. This crank shaft 7 penetrates the bearing of the frame 1. The crank shaft 7 is directly connected with the rotor 6; as the crank shaft 7 rotates (clockwise), the piston 4 reciprocates through a slider 3 which slides inside the slide tube 3*a* joined to one end of the piston 4.

The cylinder block 2 is described in detail below referring to FIG. 2. The cylinder block 2 comprises: a cylinder bore 8 through which the piston 4 passes; a bolt hole 9 which is used to join and fasten the frame 1 and cylinder block 2; and bolt holes 10 for fastening a suction valve 11, a cylinder head 12, a discharge valve 13 and a head cover 14 which constitute a valve assembly (shown in FIG. 1). The shape of the bolt holes 10 will be explained later.

Figure 2:
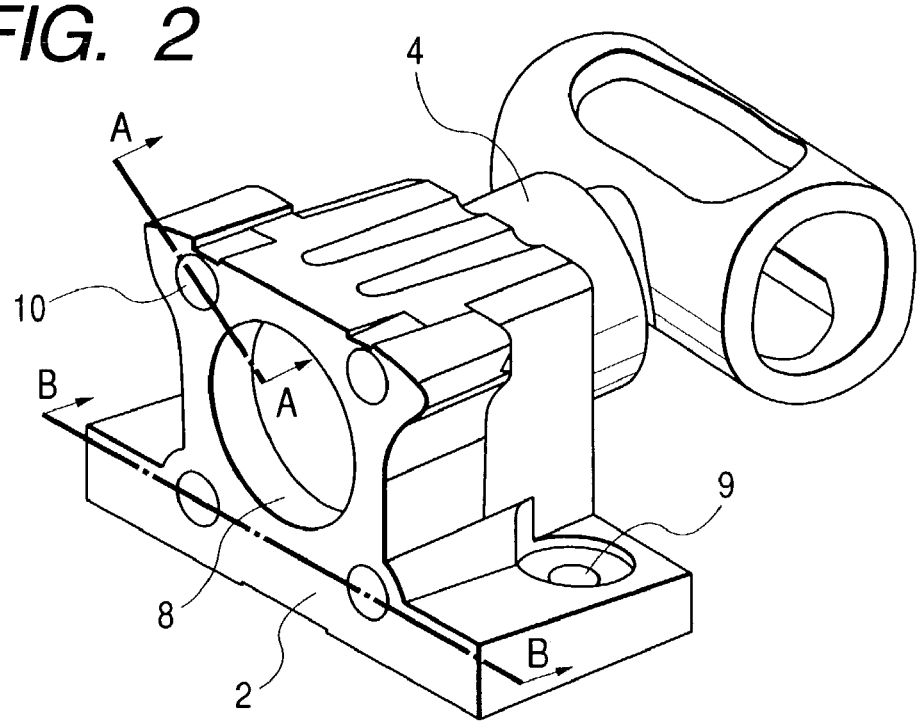
FIG. 2 illustrates a bolt hole in a cylinder block according to an embodiment of the present invention.
Figure 3:
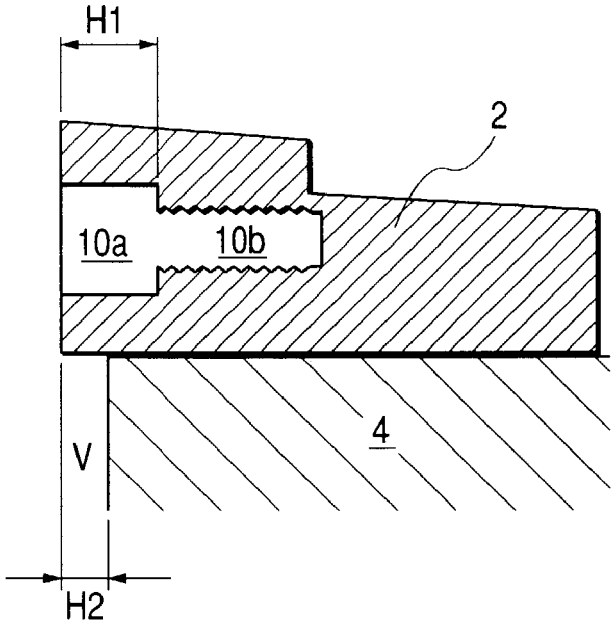
FIG. 3 is an enlarged sectional view taken along the line A—A in FIG. 2, showing a bolt hole with a hollow.

Embodiment 1:

FIG. 3 is a sectional view taken along the line A—A in FIG. 2, showing one of the bolt holes 10 for fastening the suction valve 11, cylinder head 12, discharge valve 13 and head cover 14, and its vicinity. In this figure, the suction valve 11, head cover 14 and other members are omitted. While the compressor is operating, space V, which is comprised of the cylinder block 2, the piston 4 and the suction valve 11 (not shown), serves as a compression space.

The bolt hole 10 is comprised of a hollow portion 10*a* with length H1 and an internally threaded portion 10*b*. Length H1 of the hollow portion 10*a* of the bolt hole 10, namely the distance from a plane flush with the open end of the bore 8 to the rear end of the hollow portion 10*a* (as viewed from the open end of the bore 8), must be longer than thickness H2 of discharge pressure space Vd which is generated when the pressure in the space V is at the discharge pressure level. As H1 is longer, the sealing tightness between the cylinder block 2 and the piston 4 is higher. A detailed explanation is given referring to FIG. 4.

Length H1 of the hollow portion 10*a* may be determined according to the amount of eccentricity R of the crank pin 7*a* of the crank shaft 7. It is desirable that length H1 of the hollow portion 10*a* be not less than 60 percent of the amount of eccentricity R. For example, it is possible that length H1 of the hollow portion 10*a* of the bolt hole 10 is 7.5 mm, thickness H2 of space Vd (space V under discharge pressure Pd) is 2.1 mm, the amount of eccentricity R of the crank pin 7*a* of the crank shaft 7 is 9.1 mm. Taking the type of refrigerant into consideration, it is desirable that length H1 of the hollow portion 10*a* be not less than 60 percent of the amount of eccentricity R for refrigerant R600*a* (isobutene) and not less than 88 percent of the amount of eccentricity R for refrigerant R134*a*.

Figure 4:
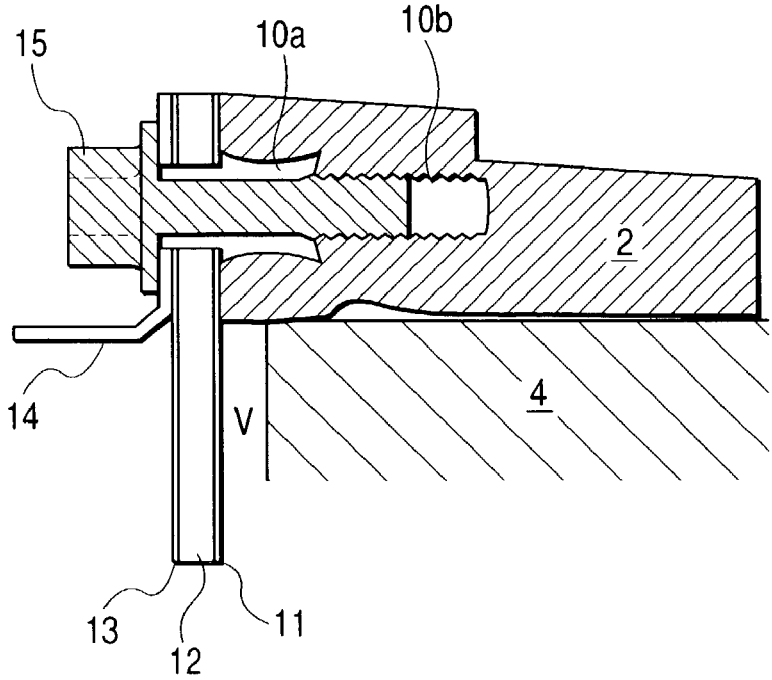
FIG. 4 schematically shows a deformation in the vicinity of a bolt hole 10 where various members are fastened and secured with a bolt 15 to a cylinder block 2 shown in FIG. 3.

Referring to FIG. 4, when the bolt 15 is tightened, the cylinder bore 8 expands outwards near the internally threaded portion 10*b* of the bolt hole 10 and thus is locally deformed. However, in this embodiment, the compression space V is away from the area of local deformation so that the sealing tightness between the cylinder bore 8 and the piston 4 does not decrease.

This local deformation is caused by a distortion which occurs when the member surrounding the internally threaded portion 10*b* is pulled by the bolt 15 with the thread of the bolt 15 engaged with the internally threaded portion 10*b*. While the piston 4 is moving inside the cylinder bore 8, some deformation of the cylinder bore 8 may not cause a significant working fluid leak as far as the working fluid pressure in the compression space is low; however, once the working fluid pressure nearly reaches the discharge pressure level, leakage would seriously decrease the compression efficiency. When the pressure in an airtight container is a discharge pressure, the influence of working fluid leakage is slight in the early phase of the compression stage because of a high pressure outside the compression space even if the sealing tightness decreases. Therefore, the distance of the internally threaded portion 10*b* from the cylinder head side open end of the cylinder bore 8 can be determined in relation to the position of the piston tip in the compression stage so that a prescribed discharge pressure is attained even if the cylinder bore 8 is deformed. In other words, the area where deformation of the cylinder bore 8 may occur is away from the area where a high sealing tightness is required between the piston 4 and cylinder bore 8.

Actually, it is when the gas pressure in the space V comes close to the discharge pressure level that a high sealing tightness is required between the cylinder bore 8 and the piston 4. In other words, if the tip of the piston 4 should come to the deformed part of the cylinder bore 8 under a discharge pressure, the sealing tightness would be lowered, resulting in compressed gas leakage.

In a concrete example of this embodiment, when the bolt 15 was tightened, the cylinder bore part in the vicinity of the internally threaded portion 10*b* of the bolt hole 10 was deformed outwards by a maximum of 7.5 .m, but the deformed part was 6.2 mm away from position H2 of the tip of the piston 4 at the moment when the compression space pressure reached the level of discharge pressure Pd, so there was no deterioration in the compressor performance.

In a hermetic type compressor thus structured according to this embodiment, when the suction valve 11, cylinder head 12, discharge valve 13 and head cover 14 are fastened and secured with the bolt 15 inserted into the bolt hole 10 constituted of the hollow portion 10*a* and the internally threaded portion 10*b*, deformation of the cylinder bore 8 occurs at a point away from the space Vd under discharge pressure Pd, so the sealing tightness between the cylinder block 2 and the piston 4 is increased and the performance of the hermetic type compressor is thus improved. For example, an excellent result was obtained when this embodiment was applied to a hermetic type compressor having a cylinder block 2 made of gray iron where the distance between the cylinder bore 8 and the bolt hole 10 was 12 mm or less and the inner diameter of the cylinder bore 8 was 20 mm or more.

In this embodiment, the "piston tip" means the valve side end of the piston 4 portion whose outer wall surface is in contact with the inner wall surface of the bore 8. Even if there is, for example, a projection on the piston 4 which reduces the dead space on the valve assembly when the piston 4 is at the top dead center during the compression stage, the above-said valve side end is considered as the piston tip.

Embodiment 2

Figure 5:
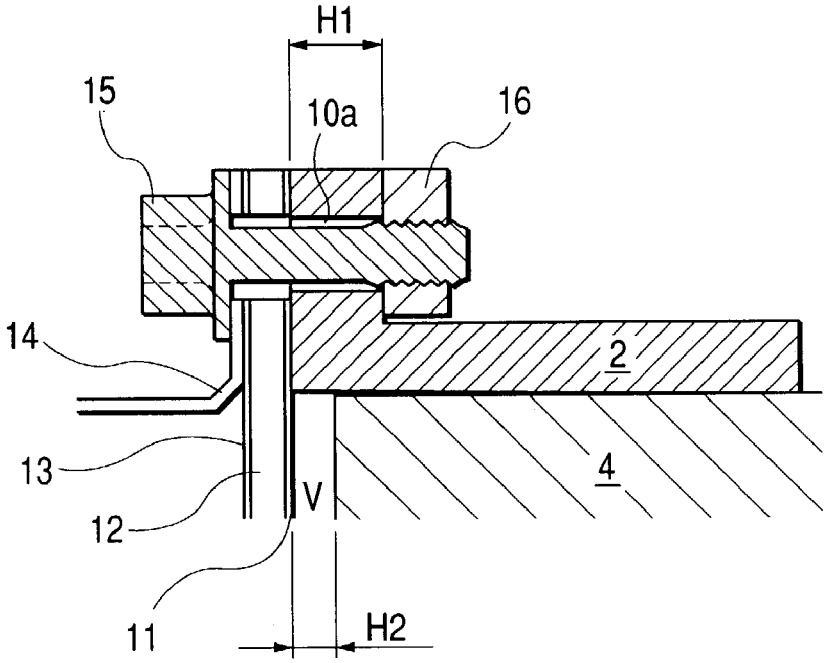
FIG. 5 is an enlarged sectional view taken along the line A—A in FIG. 2, showing the bolt hole 10 and its vicinity, where various members are fastened and secured with a bolt and a nut to a cylinder block.

While the bolt hole 10 is constituted of the hollow portion 10*a* and the internally threaded portion 10*b* in the first embodiment, the bolt hole 10 consists of a hollow portion 10*a* only in this embodiment (see FIG. 5) where the suction valve 11, cylinder head 12, discharge valve 13, head cover 14 and cylinder block 2 are sandwiched between a bolt 15 and a nut 16 and fastened and secured with them.

In this case, length H1 of the hollow portion 10*a* of the bolt hole 10 may be determined in the same way as in the first embodiment and it is desirable that it be not less than 60 percent of the amount of eccentricity R. One example of this embodiment may be as follows: length H1 of the hollow portion 10*a* of the bolt hole 10 is 7.5 mm, thickness H2 of the space Vd (space V under discharge pressure Pd) is 2.1 mm, the amount of eccentricity R of the crank pin 7*a* of the crank shaft 7 is 9.1 mm. Taking the type of refrigerant into consideration, it is desirable that length H1 of the hollow portion 10*a* be not less than 60 percent of the amount of eccentricity R for refrigerant R600*a* (isobutene) and not less than 88 percent of the amount of eccentricity R for refrigerant R134*a*.

Figure 6:
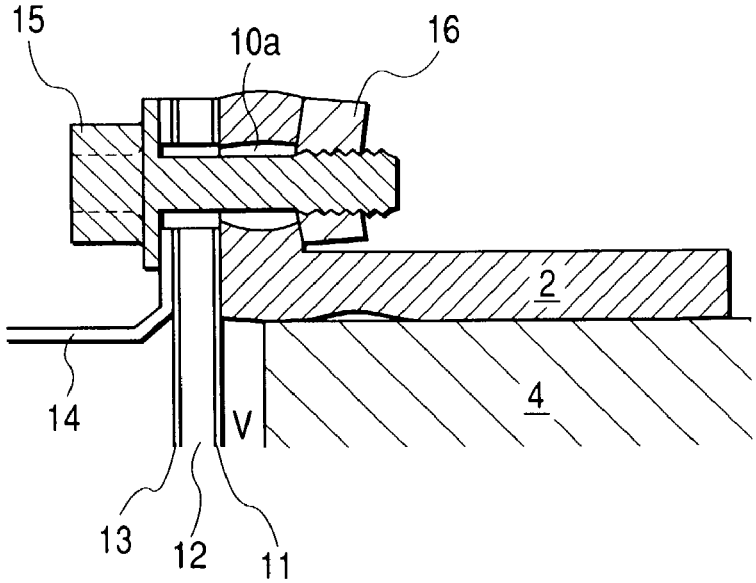
FIG. 6 is a sectional view taken along the line A—A in FIG. 2, showing schematically a deformation in the vicinity of the bolt hole 10 where various members are fastened and secured with a bolt and a nut to a cylinder block.

Referring to FIG. 6, when the bolt 15 and nut 16 are tightened, a local deformation occurs in a way that the inner diameter of the cylinder bore 8 expands in the vicinity of the nut 16. However, the area of this deformation is away from the compression space V almost under a discharge pressure, namely the area of the deformation is away from the position of the piston tip under discharge pressure Pd, so that the sealing tightness between the cylinder bore 8 and the piston 4 does not decrease. In a concrete example of this embodiment, when the bolt 15 and nut 16 were tightened, the cylinder bore part in the vicinity of the nut 16 was deformed outwards by a maximum of 5.5 .m, but the deformed part was 7.5 mm away from position H2 of the tip of the piston 4 at the moment when the compression space pressure reached the level of discharge pressure Pd, so there was no deterioration in the compressor performance.

In a hermetic type compressor thus structured according to this embodiment, when the cylinder block 2, suction valve 11, cylinder head 12, discharge valve 13 and head cover 14 are fastened and secured with the bolt 15 and nut 16, a local deformation of the cylinder bore 8 occurs at a point away from the space V under discharge pressure Pd, so the sealing tightness between the cylinder block 2 and the piston 4 is increased and the performance of the hermetic type compressor is thus improved. For example, an excellent result was obtained when this embodiment was applied to a hermetic type compressor having a cylinder block 2 made of gray iron where the distance between the cylinder bore 8 and the bolt hole 10 was 12 mm or less and the inner diameter of the cylinder bore 8 was 20 mm or more.

Embodiment 3

Figure 7:
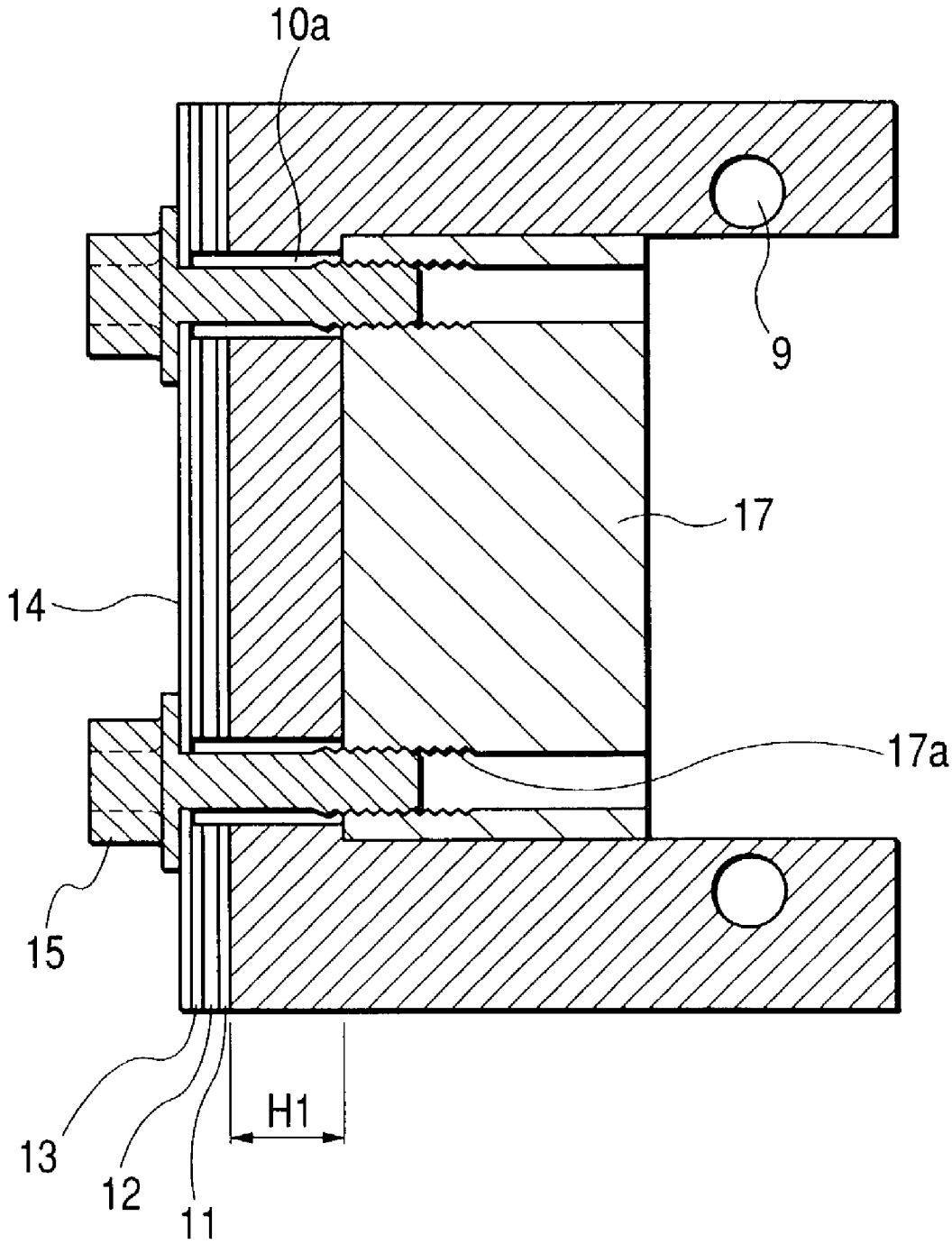
FIG. 7 is a sectional view taken along the line B—B in FIG. 2, showing the bolt hole 10 and its vicinity where various members are fastened and secured to a cylinder head.

While the bolt hole 10 is constituted of the hollow portion 10*a* and the internally threaded portion 10*b* in the first embodiment, the bolt hole 10 consists of a hollow portion 10*a* only in this embodiment (see FIG. 7) where there is an internally threaded portion 17*a* in a block 17 separate from the cylinder block 2 and the suction valve 11, cylinder head 12, discharge valve 13, head cover 14 and cylinder block 2 are sandwiched between a bolt 15 and the block 17 and fastened and secured with them.

In this case, length H1 of the hollow portion 10*a* of the bolt hole 10 may be determined in the same way as in the first embodiment and it is desirable that it be not less than 60 percent of the amount of eccentricity R. One example may be as follows: length H1 of the hollow portion 10*a* of the bolt hole 10 is 7.5 mm, thickness H2 of the space V under discharge pressure Pd is 2.1 mm, the amount of eccentricity R of the crank pin 7*a* of the crank shaft 7 is 9.1 mm. Taking the type of refrigerant into consideration, it is desirable that length H1 of the hollow portion 10*a* be not less than 60 percent of the amount of eccentricity R for refrigerant R600*a* (isobutene) and not less than 88 percent of the amount of eccentricity R for refrigerant R134*a*.

In this embodiment, when the suction valve 11, cylinder head 12, discharge valve 13 and head cover 14 are fastened and secured to the cylinder block 2 with the bolt 15 and block 17, since the bolt 15 and block 17 are tightened, a local deformation occurs around the bolt hole 10 in a way that the inner diameter of the cylinder bore 8 expands in the vicinity of the internally threaded portion 17*a* of the block 17, as in the second embodiment. However, the area of this deformation is away from the compression space V, so the sealing tightness between the cylinder bore 8 and the piston 4 does not decrease. In a concrete example of this embodiment, when the bolt 15 and block 17 were tightened, the cylinder bore part in the vicinity of the internally threaded portion 17*a* of the block 17 was deformed outwards by a maximum of 5.5 .m, but the deformed part was 7.5 mm away from position H2 of the tip of the piston 4 at the moment when the compression space pressure reached the level of discharge pressure Pd, so there was no deterioration in the compressor performance.

In a hermetic type compressor thus structured according to this embodiment, when the cylinder block 2, suction valve 11, cylinder head 12, discharge valve 13 and head cover 14 are fastened and secured with the bolt 15 and the internally threaded portion 17*a* of the block 17, a local deformation of the cylinder bore 8 occurs at a point away from the space V under discharge pressure Pd so the sealing tightness between the cylinder block 2 and the piston 4 is increased and the hermetic type compressor's performance is thus improved. For example, an excellent result was obtained when this embodiment was applied to a hermetic type compressor having a cylinder block 2 made of gray iron where the distance between the cylinder bore 8 and the bolt hole 10 was 12 mm or less and the inner diameter of the cylinder bore 8 was 20 mm or more.

Displacement compressors according to the above-mentioned embodiments of the present invention will be available in two types: one type in which the rotational frequency is constant and the other type in which it is variable. In these different types of displacement compressors, the position of the piston tip according to the present invention is not always fixed. This is because, since the pressure in the refrigeration cycle in which such a compressor is incorporated varies, the compressor discharge pressure is not constant.

However, when a displacement compressor according to the present invention is used in a refrigerator, the position of the piston tip does not vary so much with variation in the discharge pressure. For example, in a displacement compressor according to the present invention which is used for the refrigeration cycle in a refrigerator-freezer, refrigerator or the like, the piston tip is farthest away from the bore front end when the rotational frequency of the compressor is lowest. In this case, the refrigeration cycle is in a state that compression of refrigerant is least needed and the workload for the compressor should be smallest.

When a displacement compressor which rotates at a fixed speed is used for the refrigeration cycle in a refrigerator-freezer or refrigerator, it is in either of the two states: it is rotating at the fixed speed or stands still. Therefore, it is obvious that only the position of the piston tip during rotation at the fixed speed should be taken into consideration.

As discussed so far, according to preferred embodiments of the present invention, the area of a cylinder bore deformation caused by tightening the bolt is farther away from the cylinder bore open end than the position of the piston tip at the moment when the pressure in the compression space reaches the discharge pressure level while the piston, which reciprocates in the cylinder bore, is in the compression stage. Therefore, the sealing tightness between the cylinder and the piston is increased and the compressor efficiency is improved. In addition, since improvement in the compressor efficiency is achieved by the adoption of a structure which takes into consideration the positional relation between the piston tip in the compression stage and the area of cylinder bore deformation, any investment for large-scale equipment is not necessary. Furthermore, when a cylinder bore deformation is taken into account in this way at the stage of designing a compressor, a higher productivity and a lower cost can be achieved.

What is claimed is:

1. A hermetic type compressor having an airtight container comprising:

a cylinder having a bore in which a piston reciprocates;

a valve assembly which closes the open end of the bore; and a bolt which fastens the valve assembly, with a compression space including the bore, the piston and the valve assembly, wherein:

the cylinder has a bolt hole including a hollow portion through which the bolt is passed and an internally threaded portion in which a thread of the bolt is engaged;

the internally threaded portion of the cylinder is positioned adjacent the bore at a position between both ends of the bore;

the bore is locally deformed outwards near the internally threaded portion when the thread of the bolt is tightened in the internally threaded portion of the cylinder; and the distance from the open end of the bore to the position of the tip of the piston at the moment when the pressure in the compression space reaches the discharge pressure level is shorter than the distance from a plane flush with the open end of the bore to the beginning of the internally threaded portion of the cylinder which is to engage with the bolt passed through the hollow portion.

2. The hermetic type compressor as claimed in claim 1, wherein the distance from the open end of the bore to the position of the tip of the piston at the moment when the pressure in the compression space reaches the discharge pressure level is shorter than the distance from a plane flush with the open end of the bore to the rear end of the hollow portion.

3. The hermetic type compressor as claimed in claim 2, wherein an internally threaded portion which is to engage with the bolt is provided continuously with the hollow portion in the cylinder.

4. The hermetic type compressor as claimed in claim 2, wherein there is a nut having the internally threaded portion to engage with the bolt and the bolt fastens the valve assembly through the hollow portion.

5. A hermetic type compressor having an airtight container comprising:

a cylinder having a bore in which a piston reciprocates;

a valve assembly which closes the open end of the bore; and a bolt which fastens the valve assembly, a nut having the internally threaded portion in which a thread of the bolt is engaged, and with a compression space including the bore, the piston and the valve assembly, wherein:

the cylinder has a hollow portion through which the bolt is passed;

the internally threaded portion of the nut is positioned adjacent the bore at a position between both ends of the bore;

the bore is locally deformed outwards near the internally threaded portion when the thread of the bolt is tightened in the internally threaded portion of the nut; and the distance from the open end of the bore to the position of the tip of the piston at the moment when the pressure in the compression space reaches the discharge pressure level is shorter than the distance from a plane flush with the open end of the bore to the beginning of the internally threaded portion of the nut which is to engage with the bolt passed through the hollow portion.

6. The hermetic type compressor as claimed in claim 5, wherein the distance from the open end of the bore to the position of the tip of the piston at the moment when the pressure in the compression space reaches the discharge pressure level is shorter than the distance from a plane flush with the open end of the bore to the rear end of the hollow portion.

7. A hermetic type compressor having an airtight container incorporating:

a cylinder having a bore in which a piston reciprocates as the motor runs;

a valve assembly which closes the open end of the bore; and a bolt which fastens the valve assembly, with a compression space including the bore, the piston and the valve assembly, wherein:

the cylinder has a bolt hole including a hollow portion through which the bolt is passed and an internally threaded portion in which a thread of the bolt is engaged the internally threaded portion of the cylinder is positioned adjacent the bore at a position between both ends of the bore;

the bore is locally deformed outwards near the internally threaded portion when the thread of the bolt is tightened in the internally threaded portion of the cylinder; and the distance from the open end of the bore to the position of the tip of the piston at the moment when the pressure in the compression space reaches the discharge pressure level when the rotational frequency of the motor is lowest during operation of the compressor is shorter than the distance from a plane flush with the open end of the bore to the beginning of an internally threaded portion which is to engage with the bolt passed through the hollow portion.

* * * * *